United States Patent [19]

Stohlquist

[11] 4,178,737

[45] Dec. 18, 1979

[54] WRAPPING MACHINE WITH IMPROVED ARTICLE DEPOSITING APPARATUS

[75] Inventor: Roger H. Stohlquist, Rockford, Ill.

[73] Assignee: Anderson Bros. Mfg. Co., Rockford, Ill.

[21] Appl. No.: 923,078

[22] Filed: Jul. 10, 1978

[51] Int. Cl.[2] ..... B65B 9/06; B65B 39/14

[52] U.S. Cl. ..... 53/550; 53/244; 53/248; 53/249

[58] Field of Search ..... 53/550, 244, 548, 545, 53/248, 249, 235, 261

[56] References Cited

U.S. PATENT DOCUMENTS

| | | | |
|---|---|---|---|
| 2,918,769 | 12/1959 | Anderson et al. | 53/550 |
| 3,045,405 | 7/1962 | Anderson et al. | 53/550 |
| 4,004,400 | 1/1977 | Anderson et al. | 53/550 |

*Primary Examiner*—Horace M. Culver
*Attorney, Agent, or Firm*—Morsbach & Pillote

[57] ABSTRACT

A machine for wrapping elongated articles of the type in which the machine advances a strip of wrapping material past a loading station, folds the strip into a tube around the articles and longitudinally seals the strip as it is advanced past a longitudinal sealing station, and thereafter transversely seals the tube between the articles and severs the tube to form separate packages. There is disclosed an improved article depositing apparatus which includes stationary laterally spaced article guides arranged to laterally position the articles on the strip and movable forward and rear article guides that are movable from a rear position in which they converge downwardly at the loading station to guide and confine the article as it is dropped onto the loading station; forwardly through an intermediate position in which the forward and rear article guides tilt the article forwardly while confining the article therebetween; to a forward position in which the forward article guide is spaced from the rear article guide a distance sufficient to allow the article to drop on its side onto the strip of wrapping material. The forward and rear article guides are then moved back to their rear position to receive a succeeding article.

13 Claims, 11 Drawing Figures

X
56
57c
54
57a
58
48
53
35
A
33
34
61
57b
S
46
32a
62
31a
45
X
49
32b
W
45a
52
46a
25b
24
24a
26
25
22

56
57c
54
58
48
57a
33
35
A
34
53
61
46
32b
32a
62
31a
S
49
45
W
45a
52
46a
X
25b
24
24a
26
25a
25
22

53
54
58
56
48
57b
57a
33
35
A
34
57c
61
32b
32a
45
31a
45a
46
49
62
W
46a
25a
25b
S
24
X
24a
52
26
25
22

WRAPPING MACHINE WITH IMPROVED ARTICLE DEPOSITING APPARATUS

BACKGROUND OF THE INVENTION

Article wrapping machines have heretofore been made in which articles are deposited on a strip of wrapping material at a loading station, the strip of wrapping material is enfolded into a tube and longitudinally sealed as it is advanced, and the enfolded tube is thereafter transversely sealed between the articles in the tube and severed to form separate packages, for example as shown in U.S. Pat. Nos. 2,918,769; 3,045,405 and 4,004,400. Such machines are commonly used for wrapping frozen confection bars of the type having stick handles and, when wrapping such stick confections it has been found preferable to have the stick handles lead as they are advanced through the machine. Different types of article depositing apparatus are disclosed in the wrapping machines in U.S. Pat. Nos. 3,045,405 and 4,004,400 for receiving the articles as they are dropped onto the strip of wrapping material at the loading station and for tilting the articles forwardly and onto the strip of wrapping material so that the sticks lead during advance of the articles through the machine. However, the stick confections are formed in various different shapes and configurations, and it was found that some articles would turn either as they were dropped endwise onto the strip of wrapping material at the loading station or as they were tipped forwardly onto the strip of wrapping material, so that some of the articles would fall on their edges instead of on their sides and cause a jam-up in the machine.

SUMMARY OF THE INVENTION

It is the object of the present invention to overcome the disadvantages of the prior art by providing an article wrapping machine having an improved article depositing apparatus which is arranged to engage and confine the articles against turning as they are dropped onto the strip of wrapping material at the loading station and while they are tilted forwardly and which releases the articles only after they have been tipped forwardly sufficient to allow them to reliably fall on their sides.

Accordingly, the present invention provides an article depositing apparatus at the loading station which includes lateral article guides for laterally positioning the article on the strip and forwarded rear article guides disposed between the lateral article guides and movable from a rear position in which the forward and rear article guides extend downwardly at the front and rear sides of the loading station with their lower ends spaced apart a distance to laterally confine the elongated article against lengthwise turning when the article is dropped endwise therebetween onto the strip of wrapping material at the loading station; through an intermediate position in which the forward and rear article guides extend downwardly between the lateral article guides adjacent the forward side of the loading station with their lower ends spaced apart a distance to laterally confine the elongated article therebetween against turning about its lengthwise axis while tilting the elongated article forwardly; to a forward position in which the forward article guide has its lower ends spaced from the rear article guide and from the article loading station a distance sufficient to allow the article to fall downwardly on its side onto the strip of wrapping material.

The rear article guides are advantageously mounted for swinging movement about an axis adjacent the strip of wrapping material at the loading station and the forward article guide is advantageously connected by a link means to the rear article guide for movement thereby with cam means for controlling movement of the link means and forward the article guide relative to the rear article guide as the latter moves from its rear through its intermediate to its forward positions.

These, together with other objects, features and advantages of the present invention will be more readily understood by reference to the following detailed description, when taken in connection with the accompanying drawings wherein:

FIGS. 1 and 1*a* are fragmentary side elevational views respectively of the outlet and inlet portions of an article wrapping machine embodying the present invention;

The present invention relates to improvements in machines for wrapping articles of the type in which the machine advances an elongated strip of wrapping material past a loading station, articles are deposited on the strip at the loading station, the strip is folded into a tube around the articles and longitudinally sealed as the strip is advanced past a longitudinal sealing station, and the strip is thereafter transversely sealed between the articles and severed to form separate packages. The improved article depositing mechanism of the present invention is herein shown applied to a wrapping machine of the type disclosed in the U.S. patent to Ralph F. Anderson and Leo Strombeck, U.S. Pat. No. 4,004,400 issued Jan. 25, 1977, the disclosure of which is hereby incorporated herein by reference. As more fully disclosed in the aforementioned patent, the wrapping machine is advantageously of the multi-lane type for simultaneously receiving and wrapping a plurality of articles corresponding to the number of lanes in the wrapping machine. In general, the machine includes an article depositing mechanism A for depositing the articles on the strip; a longitudinal strip folding mechanism B for folding the strips into tubes around the articles; longitudinal seaming mechanism C for sealing the edges of the enfolded tubes, and transverse sealing and feed mechanism D that includes upper and lower jaw assemblies E and F operative to grip the enfolded tubes therebetween to advance the strips of wrapping material through the wrapping machine and a transverse sealing and severing mechanism G operated in timed relation with the upper and lower jaw assemblies to seal and sever the wrapper while it is gripped therebetween. An endless type inlet conveyor H extends between the article depositing mechanism A and the transverse sealing and feeding mechanism D to underlie and support the strip of wrapping material and the articles thereon. As disclosed in the aforementioned U.S. Pat. No. 4,004,400, the infeed conveyor has article clamp members arranged to engage opposite side edges of the wrapper to hold the articles in position.

Figure 1:
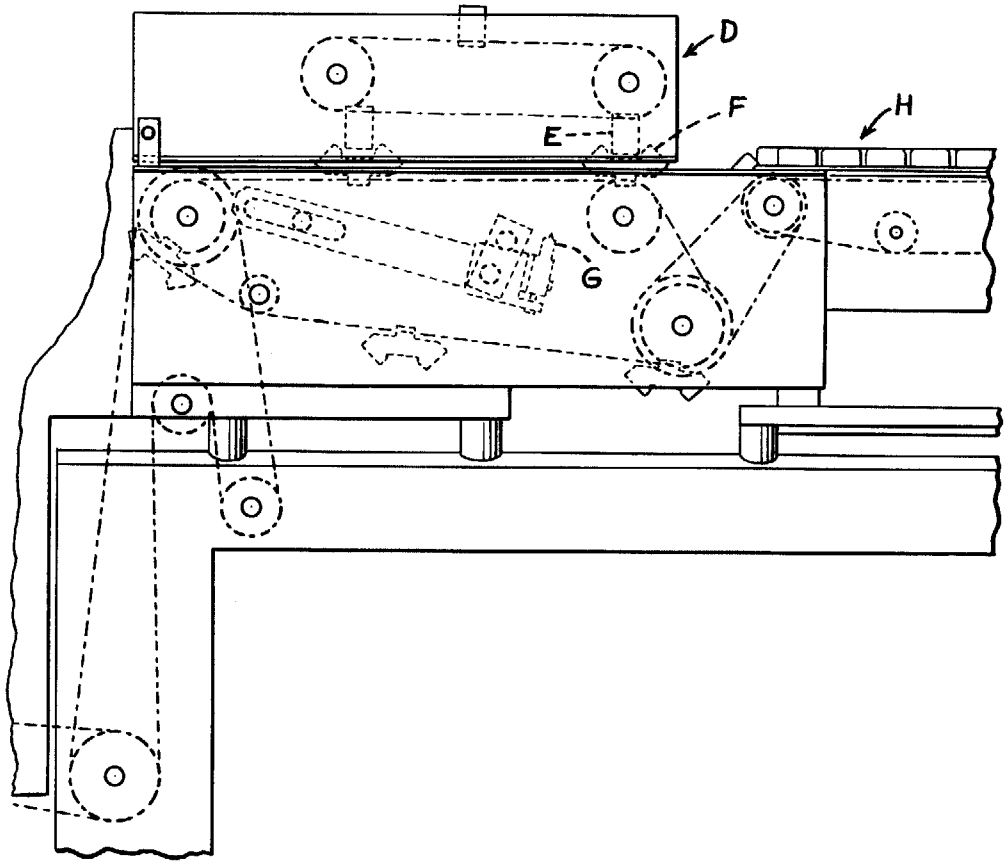
Figure 10:
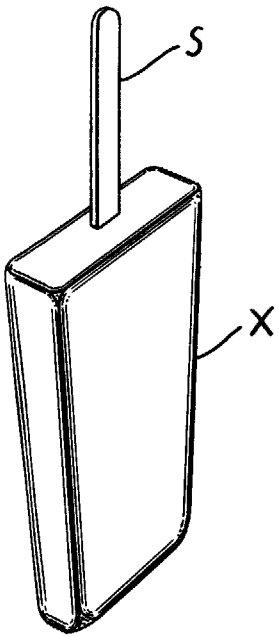
FIG. 10 is a perspective view of one type of confection adapted to be wrapped by the article wrapping machine.
Figures 1A, 2, 3:
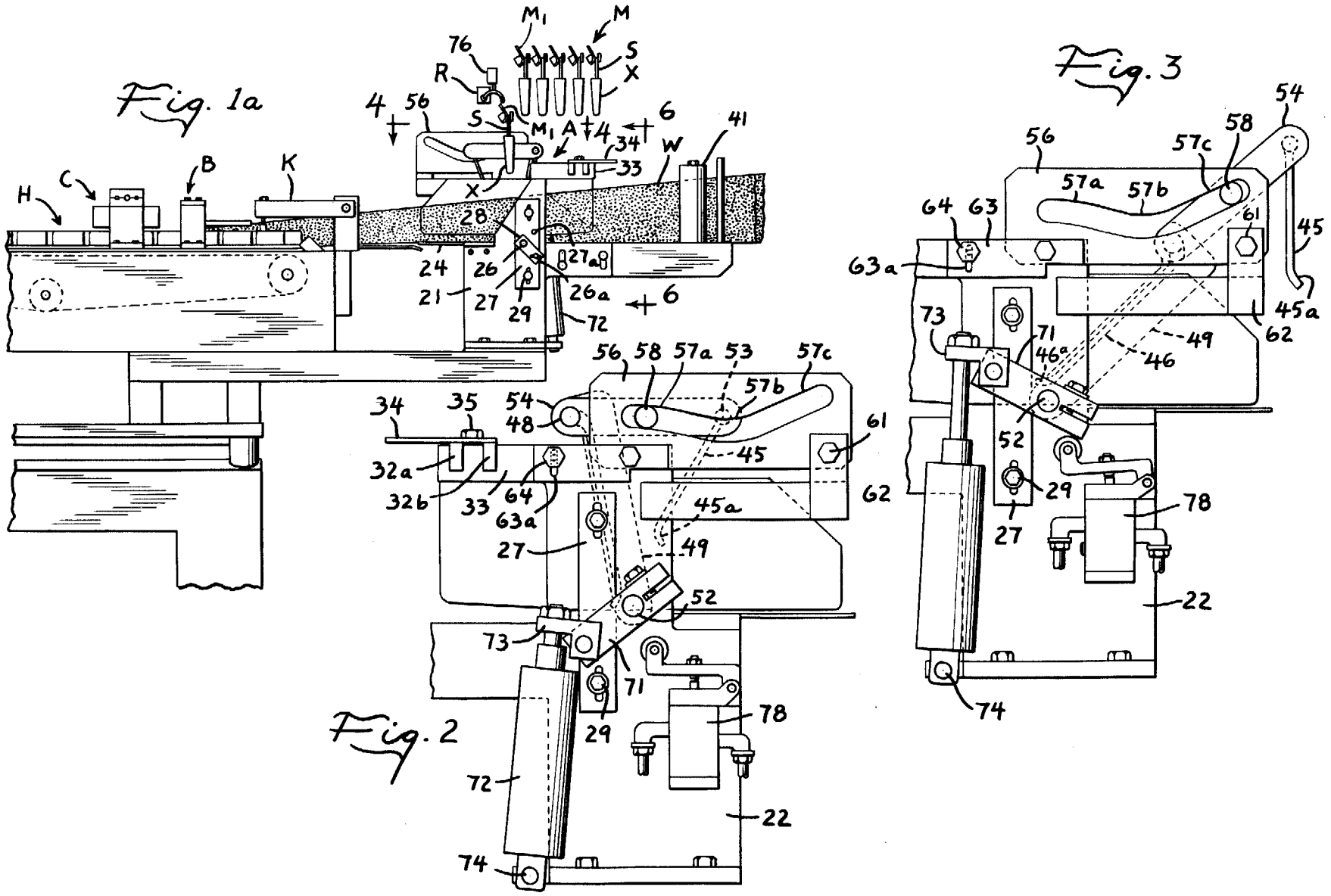
FIGS. 2 and 3 are fragmentary elevational views of the article infeed mechanism taken at the side opposite that shown in FIG. 1*a* and illustrating the parts at different moved positions.

The articles X are herein shown in the form of frozen stick confections having a stick handle S. The articles are supplied to the article wrapping machine by a machine M which is conveniently the same machine which forms the articles. As shown in FIG. 1*a*, the articles are transported with their stick handles S held in clamps $M_1$ to a position above the loading station and the articles are sequentially released from the clamps $M_1$ by an article release mechanism R on the machine M when they are above the loading station so that they drop endwise onto the strip of wrapping material at the loading station.

Figure 7:
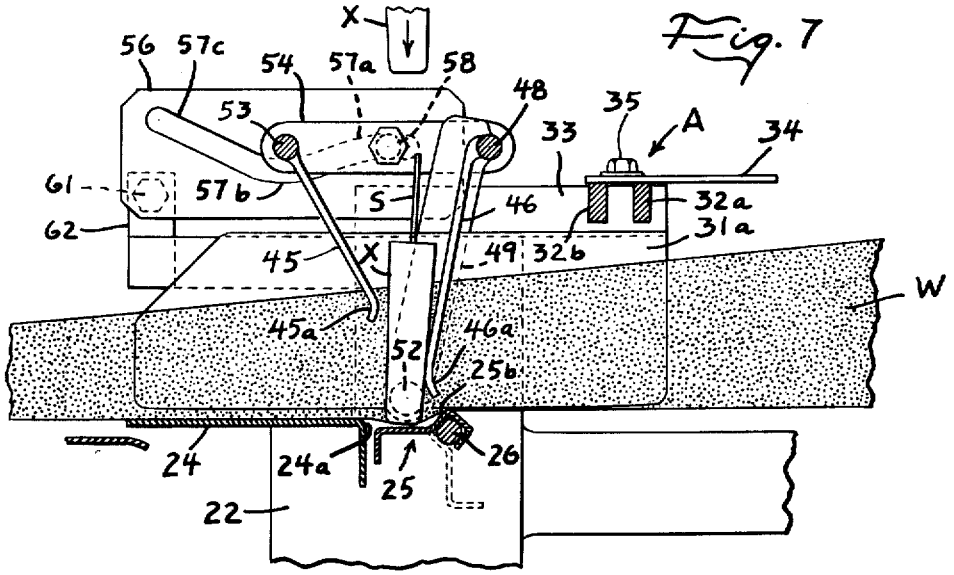
FIGS. 7–9 are fragmentary longitudinal sectional views taken on the plane 7—7 of FIG. 4, and illustrating the article depositing mechanism in different moved positions.
Figure 8:
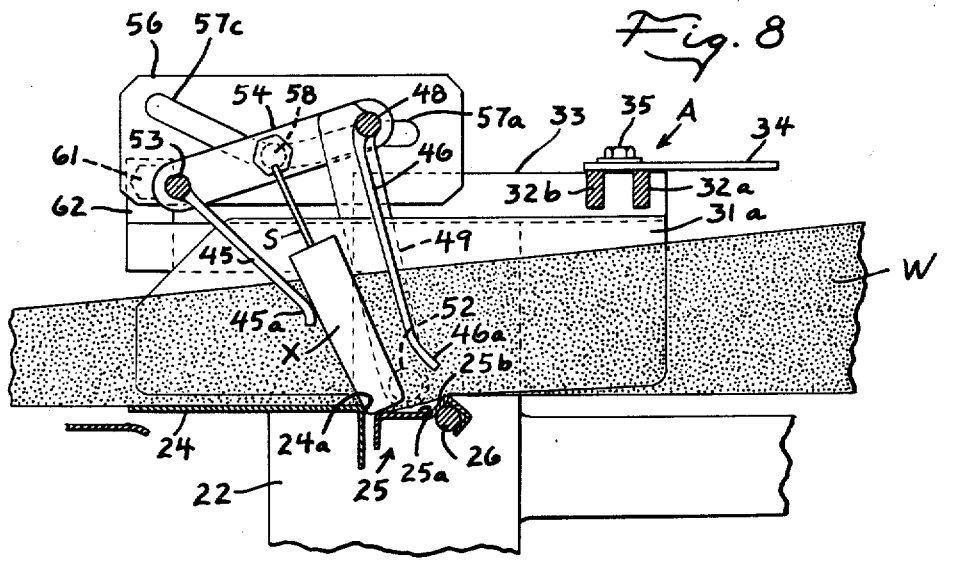
Figure 9:
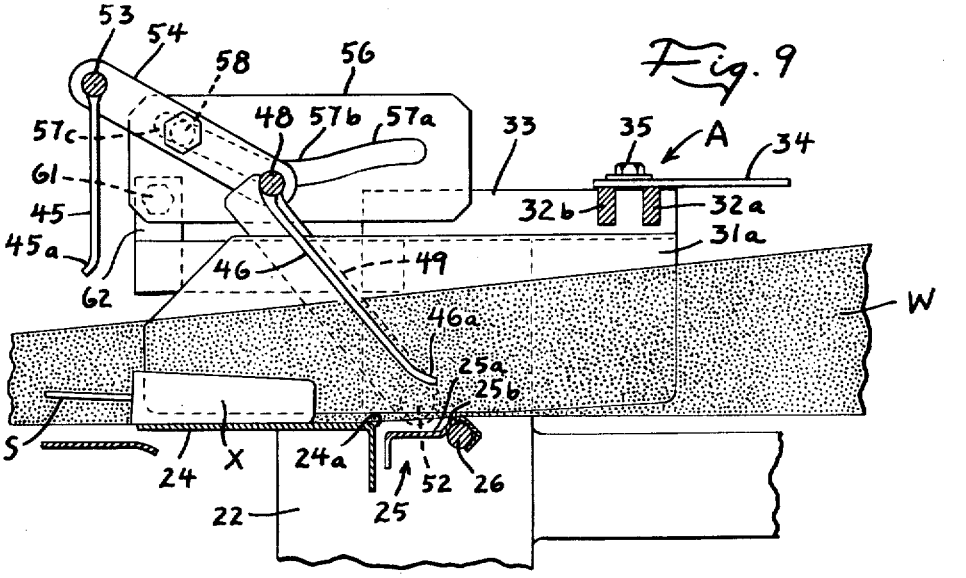

The article depositing mechanism A of the present invention is arranged to receive the articles as they are dropped onto the strip of wrapping material, tilt them forwardly and then allow them to drop on their side onto the strip of wrapping material. The article depositing mechanism A includes a pair of upright mounting plates 21 and 22 attached to the frame of the wrapping machine adjacent opposite sides thereof. A support plate 24 is secured to the mounting plates 21 and 22 and extends therebetween at a level adjacent the level of the inlet conveyor H, to underlie and support the strip of wrapping material and the articles thereon. As best shown in FIGS. 7–9, an article stop 25 is provided at the article loading station and includes an article engaging face 25*a* arranged to underlie the strip of wrapping material and form a stop that engages the end of the article when it is dropped onto the strip of wrapping material. The face 25*a* is preferably offset slightly below the level of the support plate 24 so that the rear end 24*a* of the support plate forms a shoulder or abutment adjacent the forward end of the loading station and the rear portion of the article stop is formed with an upwardly extending flange or abutment 25*b* to provide an abutment at the rear side of the loading station. As shown in FIG. 9, the strip of wrapping material will normally extend across the abutments 24*a*, 25*b* above the article stop 25. However, when an article is dropped endwise onto the wrapping material at the loading station, the strip is pressed downwardly against the article stop and forms a shallow depression in the strip crosswise of the path of advance. This inhibits movement of the end of the article in a direction lengthwise of the strip as the article is tilted forwardly. The article stop 25 is advantageously supported as on a cross shaft 26 that is rotatably mounted in brackets 27 on the mounting plates 21 and 22, for swinging movement between its article stop position shown in solid lines in FIGS. 7–9, to an aritcle discharge position shown in phantom in FIG. 7. As shown in FIG. 1*a*, a lever 28 is attached to one end of the cross shaft 26 and has a locking pin 26*a* which can be selectively received in openings 27*a* in one of the brackets 27 to secure the article stop in either its article stop position or its article discharge position. The article stop can be moved to its discharge position shown in phantom in FIG. 7 to allow discharge of articles dropped at the loading station in the absence of a strip of wrapping material thereat. As shown in FIG. 1*a*, brackets 27 are preferably mounted for limited vertical adjustment relative to the mounting plates 21 and 22 as by bolts 29 that extend through slotted openings in the brackets 27, to enable adjustment of the amount of offset between the article stop 25 and the support plate 24.

Figure 4:
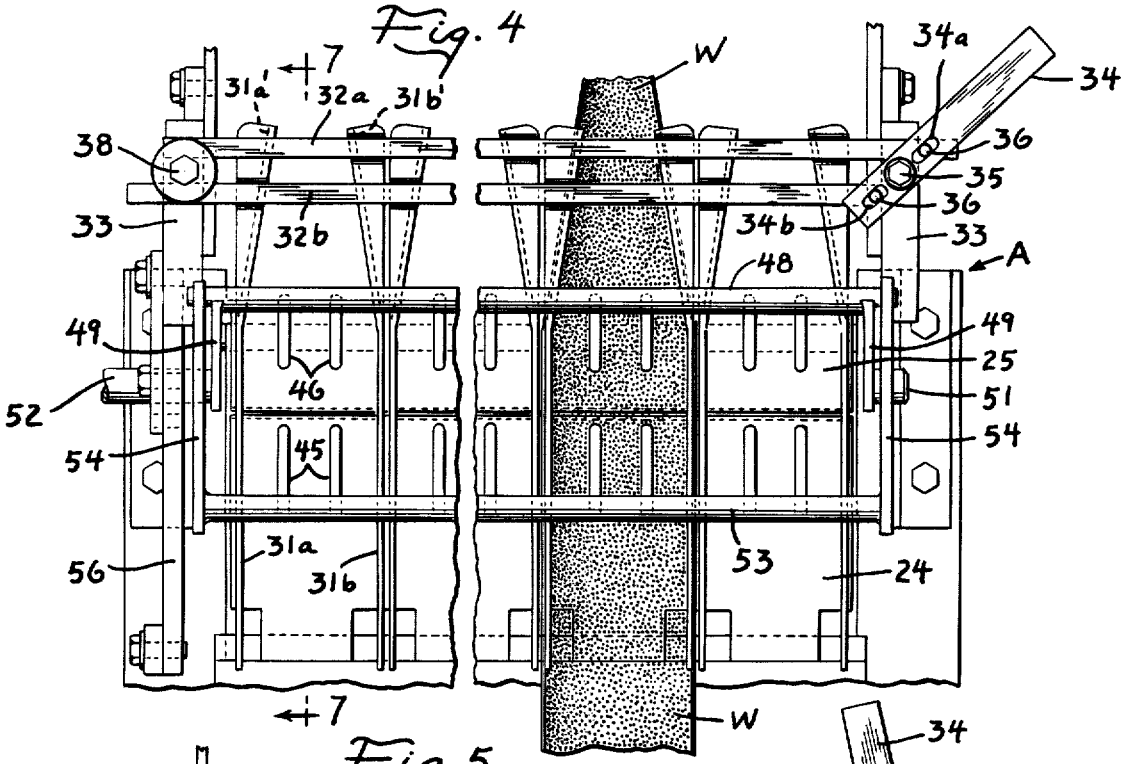
FIGS. 4 and 5 are fragmentary top plan views of the article infeed mechanism taken on the plane 4—4 of FIG. 1*a* and illustrating parts in different moved positions.
Figure 5:
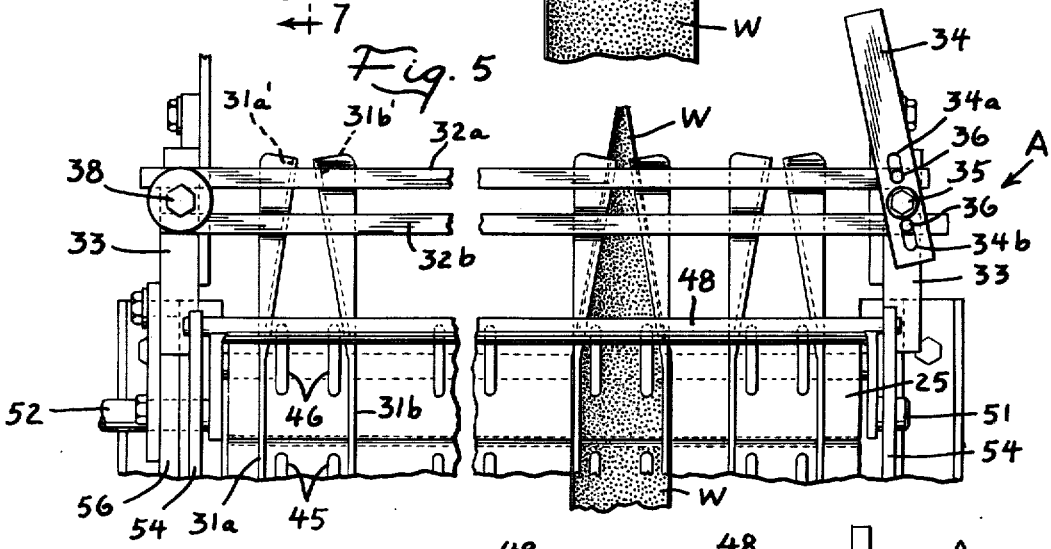
Figure 6:
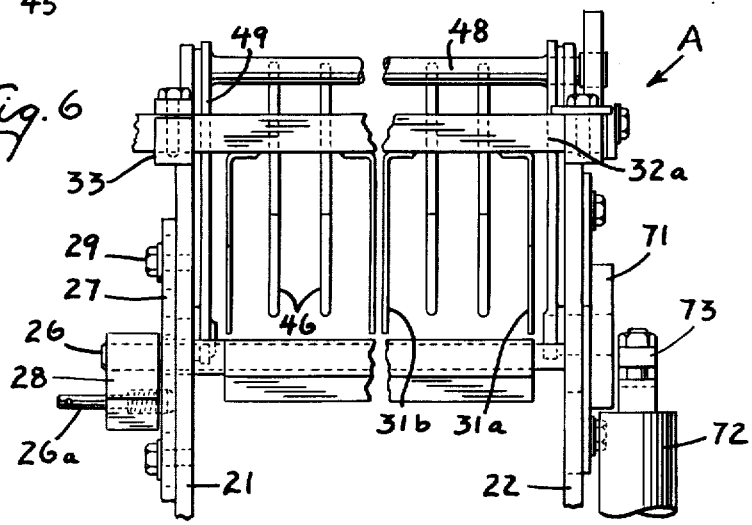
FIG. 6 is a fragmentary transverse sectional view taken on the plane 6—6 of FIG. 1*a;*

A pair of lateral article and wrapping guides 31*a*, 31*b* are provided for each lane of the multi-lane wrapping machine. The lateral article guides are spaced apart in a direction crosswise of the path of advance of the strip of wrapping material and, in order to accommodate articles of different widths, the lateral article guides 31*a* and 31*b* are respectively mounted on cross bars 32*a* and 32*b* for adjustment toward and away from each other. Cross bars 32*a* and 32*b* extend crosswise of the wrapping machine and are slidably supported adjacent their ends in notches formed in support brackets 33 attached to the mounting plates 21 and 22. As best shown in FIGS. 4 and 5, a lever 34 is pivotally mounted as on a stud 35 intermediate the cross bars 32*a* and 32*b*, and the lever has slots 34*a* and 34*b* which receive pins 36 on the cross bars to move the cross bars equal amounts in relative opposite directions in response to swinging of the lever. Thus, the lateral article guides 31*a* and 31*b* on each lane can be simultaneously adjusted from a relatively wide position as shown in FIG. 4, to a narrow position as shown in FIG. 5. A knob 38 is threaded into one of the brackets 33 between the cross bars 32*a* and 32*b* and can be tightened to lock the cross bars in adjusted position.

The lanes of the multi-lane wrapping machine are spaced on centers substantially narrower than the widths of the strips of wrapping material. In order to feed the strip of wrapping material W to the several lanes, the strips are folded flat upon themselves and passed over guide rolls such as shown at 41 in FIG. 1*a* which is aligned with the center of the respective lane of the wrapping machine. After the folded strip of wrapping material passes over its guide roll 41, the folded strip is opened into an upwardly opening U-shaped channel with the central portion of the strip passing over the article stop 25 and guide plate 24 and with the side portions of the strip extending upwardly along the outer sides of the lateral article guides, as shown in FIGS. 4 and 5. The inlet end portions 31*a*′ and 31*b*′ of the lateral article guides of each pair are preferably formed to converge somewhat as shown in FIGS. 4 and 5 and thus facilitate opening of the folded wrapper strip into an upwardly opening U-shaped channel. An apparatus for feeding strips of wrapping material from a plurality of rolls, folding the strips into face-to-face contact, and guiding the same to a multi-lane wrapping machine is disclosed in U.S. Pat. No. 2,918,769 issued Dec. 29, 1959 and reference is made to that patent for a more complete description of the apparatus for feeding, folding, and guiding the strips of wrapping material to the multi-lane wrapping machine.

It is desirable when wrapping certain types of articles such as frozen stick confections to deposit the articles on the strip of wrapping material so that the smaller or stick end of the articles leads during advance of the articles through the wrapping machine. The articles such as frozen stick confections are made in various different shapes and sizes and some difficulties have been encountered in wrapping some styles of articles on the prior wrapping machines due to the tendency of the articles to turn about their axis when being dropped onto the loading station or when they are tilted forwardly onto the strip of wrapping material, with the result that the articles will sometimes fall on edge and cause a jam-up somewhere in the wrapping machine. The article depositing apparatus of the present invention has movable forward and rear article guides 45 and 46 arranged to guide and confine the article while it is dropped onto the strip of wrapping material at the loading station and while the article is tilted forwardly and allowed to fall on its side onto the strip of wrapping material. As shown in FIGS. 7–9, the forward and rear article guides are movable from a rear position in which they converge downwardly at the front and rear sides of the article loading station to guide the article as it is dropped onto the strip of wrapping material at the loading station and with their lower ends spaced apart a distance sufficiently close to laterally confine the article therebetween and inhibit turning of the article about its lengthwise axis; through an intermediate position as shown in FIG. 8 in which the front and rear article guides converge downwardly adjacent the forward guide of the article loading station and with their lower ends spaced apart a distance sufficiently close to laterally confine the article therebetween and inhibit turning of the article about its lengthwise axis; to a forward position as shown in FIG. 9 in which the forward article guides are moved away from the rear article guides a distance sufficient to allow the article to drop on its side.

The rear article guides 46 are attached at their upper ends to a rear guide support bar 48 and the rear article guides are preferably in the form of rods or bars, at least two for each lane of the wrapping machine, and which extend downwardly and terminate in rearwardly curved end portions 46*a* which are spaced above the strip of wrapping material at the loading station a distance substantially less than the height of the article to be wrapped. The rear article guides are supported for swinging movement about an axis adjacent the strip of wrapping material at the loading station and the ends of the rear guide support bar 48 are rigidly secured to the upper ends of arms 49 that are swingably supported by laterally extending trunions 51, 52 rotatably supported in the upright mounting plates 21 and 22. As best shown in FIGS. 7–9, the axis of the trunions 51, 52 is closely adjacent the level of the strip of wrapping material at the loading station and the rear article guides 46 extend from the rear guide support bar 48 downwardly toward the axis of the trunnions 51, 52. The rear article guides thus extend in a plane that is generally radially of the axis of the trunions 51, 52 as the rear article guides are moved from the rear position shown in FIG. 7 through the intermediate position shown in FIG. 8 and to the forward position shown in FIG. 9.

The forward article guides 45 are fixedly attached at their upper ends to a forward guide support bar 53 and the forward article guides 45 are also conveniently in the form of elongated rods or fingers, at least two for each lane, that extend downwardly from the bar 53 and terminate in forwardly curved lower end portions 45*a*. A pair of links 54 are pivotally connected at one end to the upper end of a respective one of the arms 49 and conveniently and pivotally mounted on the ends of the rear guide support bar 48. The links extend forwardly and are rigidly secured to opposite ends of the forward guide support bar 53 so that the forward guide support bar is moved by the arms 49. A cam 56 is mounted alongside the path of travel of one of the links 54 and has a cam track that is engaged by a follower 58 on the link. The follower extends laterally of the link intermediate the forward and rear guide support bars 53 and 48 and the cam track has a first portion 57*a* which is arcuate and generally concentric with the axis of the trunions 51, 52; a transition portion 57*b* intermediate its ends, and an outlet portion 57*c* that extends upwardly and forwardly from the transition portion 57*b*. The forward article guides 45 are attached through the forward guide support bar 53 to the link to extend downwardly and rearwardly toward the axis of the trunions 51, 52 when the arms 49 are in their rear position shown in FIG. 7, and with the lower ends 45*a* of the forward article guides spaced from the lower ends 46*a* of the rear article guides 46 a distance only slightly greater than the thickness of the article, to guide the article when it is dropped onto the loading station and to laterally confine the article against turning about its lengthwise axis, as it is dropped on the strip of wrapping material. Since the inlet portion 57*a* of the cam track 57 is substantially concentric with the axis of the trunions 51, 52, the cam follower 58 riding in the inlet portion of the cam track will maintain the forward article guides in downwardly converging relation to the rear article guides as the forward and rear article guides are moved from the rear to the intermediate position shown in FIG. 8. In that position, the rear article guides are inclined downwardly and rearwardly so as to positively tilt the article forwardly and the forward article guides have their lower ends spaced from the lower ends of the rear article guides and from the loading station a distance such as to laterally confine the articles therebetween to prevent turning of the articles about their lengthwise axis as they are tilted forwardly. As the arms 49 move forwardly from the intermediate position shown in FIG. 8 to the forward position shown in FIG. 9, the cam follower 58 rides upwardly in the outlet portion 57*c* of the cam track to lift the forward article guides and swing the guides to a more nearly upright position sufficient to allow the articles to fall forwardly on their side as shown in FIG. 9. The arms 49 are then swung back to the position shown in FIG. 7 to return the forward rear article guides to FIG. 7 position. In order to enable adjustment of the spacing between the lower ends of the article guides in the rear and intermediate position, provision is made for limited adjustment of the cam 56. As best shown in FIGS. 3 and 4, the cam 56 is supported at one end by a bolt 61 on a bracket 62 secured to the mounting plate 22. The other end of the cam has a bracket 63 rigidly secured thereto and the bracket is attached to the mounting plate 22 by bolts 64 that extend through vertically elongated openings 63*a* in the bracket 63, so that the rear end of the cam can be adjusted vertically to a limited extent. As will be seen, lowering of the rear end of the cam plate has the effect of moving the cam follower 58 and link 54 downwardly when the arms 49 are in their rear position and this decreases the spacing between the forward article guides 45 and the rear article guides 46. Conversely, raising the cam would increase the spacing between the forward article guides to accommodate articles having a greater thickness.

Any suitable means may be provided for operating the article depositing mechanism in timed relation with the wrapping machine. As shown in FIGS. 2 and 3, an arm 71 is rigidly secured to one of the trunions 52 and a fluid cylinder 72 is connected at the one end by a bracket 73 to the outer end of the arm 71 and is pivotally anchored at the other end by a pivot 74 to the mounting plate 22. As shown in FIG. 2, the forward and rear article guides are in the rear position when the cylinder 72 is retracted and they are moved to their forward position when the cylinder is extended. Fluid pressure is selectively applied to the cylinder 72 under the control of a switch such as a fluid control valve 76 (FIG. 1*a*) conveniently operated by the article release mechanism R that releases the articles from the machine M at the loading station. Thus, the article depositing mechanism is operated each time articles are released from the machine M to allow the articles to drop onto the strip of wrapping material at the loading station. As described more fully in the aforementioned U.S. Pat. No. 4,004,400 the wrapping machine is operated through one cycle by a one revolution clutch (not shown) to advance the jaw assemblies E and F on the transverse sealing and feed mechanism D a distance corresponding to the pitch distance between adjacent jaw assemblies. The jaw assemblies E and F grip the wrapper W therebetween and pull the wrapper through the wrapping machine and past the article depositing mechanism A. A switch 78, conveniently a fluid control valve, is operated by the lever 71 on the article depositing mechanism, when the article guides reach their forward position shown in FIG. 3, to thereby operate the wrapping machine in timed relation with the article depositing mechanism and to advance the wrapper past the loading station. As also described more fully in the aforementioned U.S. Pat. No. 4,004,400 article stop mechanism K (FIG. 1*a*) is provided between the article depositing station and the longitudinal seaming station and the article stop mechanism is operated in timed relation with the advance of the strip of wrapping material to position the articles at the proper spacing along the strip of wrapping material.

From the foregoing it is thought that the construction and operation of the article depositing mechanism for the wrapping machine will be readily understood. Articles are supplied by a machine M to a position above the article loading station A and the article release mechanism R on the machine M is operated to sequentially release the articles and allow them to drop onto the strip of wrapping material at the loading station. The article release mechanism on the machine M also operates a switch 76 that controls the application of fluid pressure to the cylinder 72 to move the cylinder from its retracted position shown in FIG. 2 to its extended position shown in FIG. 3 and back after the article has been dropped onto the strip of wrapping material at the loading station. The lateral article guides 31*a* and 31*b* are adjusted in accordance with the width of the articles to be wrapped to laterally position the articles on the strip of wrapping material and the forward and rear article guides converge downwardly as shown in FIG. 7 when in their rear position to guide the article onto the loading station and to laterally confine the article against lengthwise turning as it is dropped onto the strip of wrapping material at the loading station. As the cylinder 72 is extended, it swings the arm forwardly from the rear position shown in FIG. 7 through an intermediate position shown in FIG. 8 to the forward position shown in FIG. 9 and then back to the rear position when the cylinder is retracted. In the intermediate position shown in FIG. 8, the forward and rear article guides converge downwardly adjacent the forward side of the loading station to tilt the article forwardly while still laterally confining the article therebetween and as the article guides move to the forward position shown in FIG. 9, the forward article guide is moved forwardly and upwardly away from the rear article guide a distance sufficient to allow the article to drop forwardly on their side onto the strip of wrapping material. As the article depositing mechanism reached its forward position shown in FIG. 3, it also operates the switch 78 to initiate one cycle of the wrapping machine. As the wrapping machine advances through a cycle, it pulls the strip of wrapping material past the loading station so that a succeeding article can be deposited on the strip of wrapping material.

The embodiments of the invention in which an exclusive property or privilege is claimed are defined as follows:

1. In a machine for wrapping elongate articles of the type having means for advancing a strip of wrapping material lengthwise in a forward direction along a generally horizontal path past an article loading station and wherein elongate articles are intermittently dropped endwise onto the strip of wrapping material at the loading station, article depositing apparatus above the strip at the loading station including a pair of lateral article guides and elongate forward and rear article guides, the lateral article guides being spaced apart in a direction crosswise of the path of advance of the strip to laterally position the article on the strip, forward and rear guide support means disposed above the lateral article guides and respectively supporting the elongate forward and rear article guides adjacent their upper ends, means mounting the forward and rear guide support means for movement from a rear position in which the forward and rear article guides extend downwardly between the lateral article guides respectively at the front and rear sides of the article loading station with their lower ends spaced apart a distance to laterally confine the elongate article against lengthwise turning when the article is dropped endwise therebetween onto the strip of wrapping material at the loading station; forwardly through an intermediate position in which the forward and rear article guides extend downwardly between the lateral article guides adjacent the forward side of the loading station with their lower ends spaced apart a distance to laterally confine the elongate article therebetween against lengthwise turning while tilting the elongate article forwardly; to a forward position in which the forward article guide has its lower end spaced from the rear article guide and from the article loading station a distance sufficient to allow the elongate article to fall forwardly on its side onto the strip of wrapping material, and means for moving the forward and rear guide support means through an article depositing cycle from a rear position forwardly through said intermediate position to said forward position and then back to said rear position.

2. In a machine for wrapping articles according to claim 1 wherein said forward and rear article guides converge downwardly relative to each other in said rear and intermediate positions and diverge downwardly relative to each other in said forward position.

3. In a machine for wrapping elongate articles according to claim 1 wherein the rear article guide extends downwardly and forwardly toward the strip of wrapping material at the loading station when in said rear position and extends downwardly and rearwardly toward the strip of wrapping material at the loading station when in said intermediate and forward positions.

4. In a machine for wrapping elongate articles according to claim 1 wherein said means mounting said forward and rear guide support means includes arm means mounted at one end thereof for pivotal movement about a generally horizontal axis adjacent the strip of wrapping material at said article loading station, said rear guide support means being attached to said arm means adjacent its other end for movement with said arm.

5. In a machine for wrapping elongate articles according to claim 1 wherein said means mounting said forward and rear guide support means includes arm means pivotally mounted at its lower end adjacent the strip of wrapping material at said loading station for swinging movement in a generally upright plane, said rear guide support means being attached to the upper end of said arm means for movement therewith, and link means pivotally connected to said arm means and operatively connected to said forward guide support means for moving the latter.

6. In a machine for wrapping elongate articles according to claim 5 including cam means for controlling pivotal movement of said link means relative to said arm means.

7. In a machine for wrapping elongate articles according to claim 1 wherein said means mounting said forward and rear guide support means includes arm means pivotally mounted at its lower end for movement about a horizontal pivot axis adjacent the strip of wrapping material at the loading station, said rear guide support means being rigidly attached to the upper end of said arm means for movement therewith, said rear article guide extending downwardly from the rear article support means toward the pivot axis of said arm means.

8. In a machine for wrapping elongate articles according to claim 1 wherein said means mounting said forward and rear guide support means includes arm means pivotally mounted at its lower end for movement about a horizontal pivot axis adjacent the strip of wrapping material at the loading station, said rear guide support means being rigidly attached to the upper end of said arm means for movement therewith, said rear article guide extending downwardly from the rear article support means toward the pivot axis of said arm means, link means pivotally connected to said arm means and operatively connected to said forward guide support means for moving the latter, and cam means for controlling pivotal movement of said link means relative to said arm means.

9. In a machine for wrapping elongate articles according to claim 8 wherein said cam means is operative to maintain said forward article guide in downwardly converging relation to said rear article guide during movement from said rear to said intermediate position and to move said forward article guide into downwardly diverging relation to said rear article guide during movement from said intermediate to said forward positions.

10. In a machine for wrapping elongate articles according to claim 1 including means for adjusting the spacing between said lateral article guides.

11. In a machine for wrapping elongate articles of the type having means for advancing a strip of wrapping material lengthwise in a forward direction along a generally horizontal path past an article loading station and wherein elongate articles are dropped endwise onto the strip of wrapping material at the loading station, article depositing apparatus above the strip at the loading station including a pair of lateral article guides spaced apart in a direction crosswise of the path of advance of the strip to laterally position the article on the strip, arm means pivotally mounted at one end for movement about a horizontal pivot axis crosswise of said path adjacent the strip of wrapping material at the loading station, rear guide support means disposed above said lateral article guides and attached to said arm means for movement therewith, rear article guide means attached to said rear guide support means and extending downwardly therefrom between the lateral article guides and having its lower end spaced above the strip at the loading station a distance less than the height of the article, said rear article guide means swinging in unison with said arm means about said horizontal pivot axis from the rear position at the rear side of the article loading station through an intermediate position adjacent the forward side of the loading station to a forward position forwardly of said intermediate position, link means pivotally connected at one end to said arm means and extending forwardly therefrom, forward guide support means attached to said link means forwardly of the rear guide support means, forward article guide means extending downwardly from said forward guide support means and having its lower end spaced from the rear article guide means a distance to laterally confine the elongate article therebetween against lengthwise turning, means controlling pivotal movement of said link means relative to said arm means and operative to maintain the forward article guide means with its lower end spaced from the rear article guide means a distance to laterally confine the article therebetween against turning about its lengthwise axis as the rear article guide means moves from its rear position to its intermediate position and for moving the forward article guide means away from the rear article guide means as the latter moves from its intermediate position to its forward position to allow the article to fall on its side onto the strip of wrapping material.

12. In a machine for wrapping articles according to claim 11 wherein said forward and rear article guide means converge downwardly relative to each other in said rear and intermediate positions and diverge downwardly relative to each other in said forward position.

13. In a machine for wrapping articles according to claim 11 wherein rear article guide means extends from said rear guide support toward said pivot axis in each said rear, intermediate and forward positions, said forward article guide means extending from said forward guide support toward said pivot axis when in said rear and intermediate positions and extending downwardly from said rear guide support at a location spaced from the pivot axis a distance substantially greater than the length of the article when in said forward position.

* * * * *